United States Patent [19]

Russ

[11] Patent Number: 4,474,091

[45] Date of Patent: Oct. 2, 1984

[54] TAP WRENCH

[76] Inventor: Norman Russ, Box 508, Norwich, Conn. 06360

[21] Appl. No.: 387,271

[22] Filed: Jun. 10, 1982

[51] Int. Cl.[3] ..... B25B 19/00

[52] U.S. Cl. ..... 81/463; 81/461

[58] Field of Search ..... 81/463, 464, 465, 57.46; 74/2; 173/119, 100

[56] References Cited

U.S. PATENT DOCUMENTS 3,156,309 11/1964 Swenson ..... 173/119

3,967,506 7/1976 Billot ..... 74/2

*Primary Examiner*—James L. Jones, Jr.

*Attorney, Agent, or Firm*—McCormick, Paulding & Huber

[57] ABSTRACT

A wrench is held in a steel case body that provides added leverage to the wrench shank. The body has a clock spring that is wound, to be released for moving a hammer into contact with the wrench shank to loosen stubborn nuts or the like. A ratchet and pawl provides a convenient means to wind the spring, and a release button releases the spring so the hammer can "tap" the wrench.

1 Claim, 3 Drawing Figures

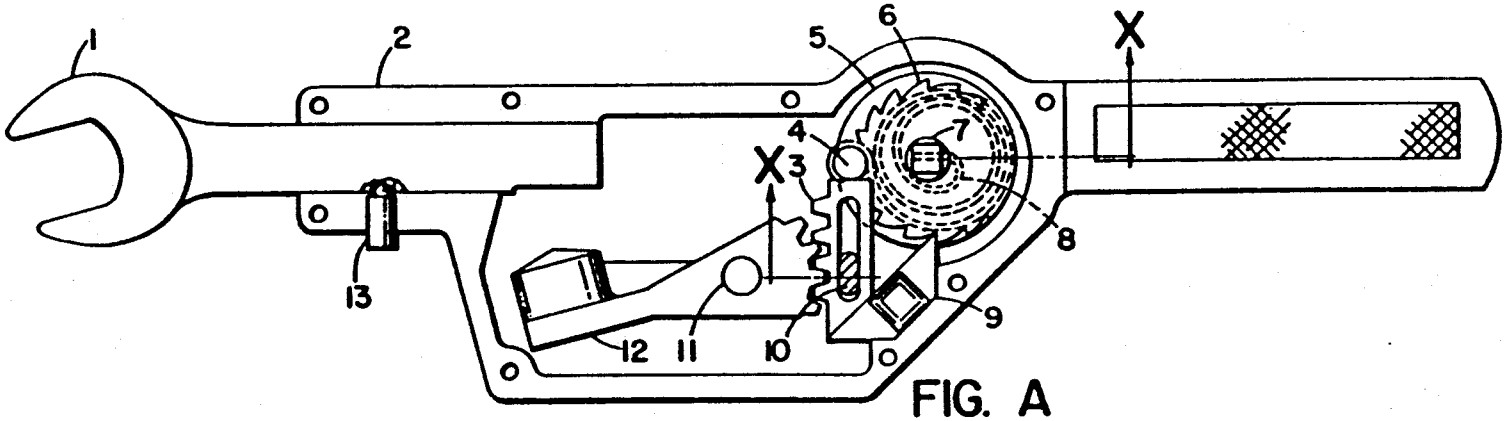
FIG. A
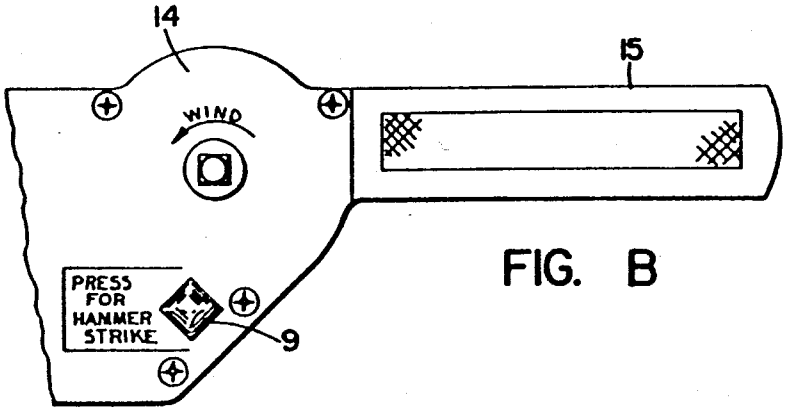
FIG. B
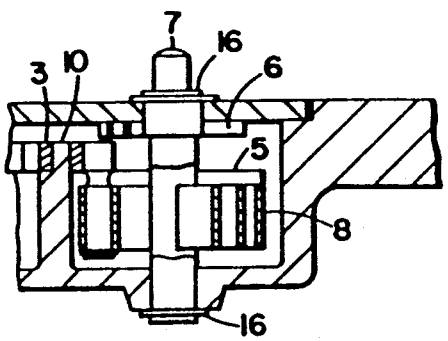
FIG. C

TAP WRENCH

This invention relates generally to devices for freeing nuts and bolts, and deals more particularly with a key wound device having a clock spring for releasing a hammer as a result of depressing a button on the outside of the housing.

FIG. A is a top view of the device with a cover plate of the housing removed to show the internal features.

FIG. B is a partial top view with the cover in place showing the square ended shaft for receiving the key to wind this spring, and the square ratchet release button with indicia printed alongside the button.

FIG. C is a vertical sectional view taken generally on the line X—X of FIG. A.

Turning now to the drawings in greater detail, the device shown in the accompanying drawing depicts a "tap wrench" fabricated from a rugged steel case and having a knurled handle 15 with provision for readily interchangeable wrench heads 1 of the open end type, box type, or socket type and so forth, and of various different size.

The invention resides in the provision within the steel housing or body 2 of a spring powered internal hammer 12 which may be released as needed to strike the inner end or shank of the wrench which projects inside the body 2 and thereby to impart an extra blow or impact of the type sometimes needed to loosen a stubborn bolt or nut.

From FIG. A it will be apparent that the wrench 1 has a shank adapted to be releasably received in a receptacle provided for this purpose in the case body 2, and to be held in place by a ball detent mechanism 13 of conventional construction. The case body 2 defines a handle 15 at the opposite end and this handle is generally aligned with the wrench shank as shown. Thus, leverage is provided for the user to manipulate the tool whether or not the hammer impact device is used.

The case body 2 is upwardly open, and cover 14 provides an enclosure through which extend the key shaft as best shown in FIG. B and the hammer release button 9 has as also shown in that view.

The case body 2 has a shaft 11 for pivotally supporting the hammer 12 in order that the hammer can be moved between a cocked position shown and an impact position wherein the free end of the hammer is adapted to abut the wrench shank. A clock spring 8 is provided on the spring winding shaft 7 so that the spring can be wound in a counterclockwise direction as suggested in FIG. B to coil the spring tightly around the key shaft 7.

Referring more particularly to FIG. C a ratchet plate 6 is provided on the key shaft 7 and has ratchet teeth defined in its periphery as shown at 6 in FIG. A. A ratchet pawl or plate 9 has the release button provided thereon and serves to normally retain the ratchet plate

6 in a position such that the key shaft 7 will permit compressing or winding the spring 8.

When the button 9 is depressed the pawl defining portion will drop below plate 6 permitting the ratchet plate to turn freely in either direction. A cross slide member or rack gear element 3 is adapted for limited movement relative to the case body 2 as a result of a slot defined therein which slot permits motion of the cross slide 3 on upstanding rack gear guide key or post 10 defined in the case body 2. The free end of the clock spring 8 is coupled to this cross slide through a striker disc stud 4 so that pressing button 9 disengages pawl from the ratchet plate 6 permitting the clock spring 8 to spin in the upwind direction. A striker disc 5 supports the stud 4 for this purpose, and this disc is also provided on the key-shaft 7 to so support the stud 4 in abutting relationship to the cross slide 3 whereby movement of the cross slide is achieved in response to spring and ratchet spinning movement as aforesaid.

I claim:

1. An impact device for a wrench of the type having a tool defining head adapted to fit a nut or bolt to be rotated and having a shank extending radially outwardly from said head, said impact device comprising a body having a receptacle for receiving said wrench shank, and having a handle extending outwardly of said shank receptacle to provide leverage for the user, a pivotably mounted hammer provided on said body and movable between a cocked position and an impact position wherein a free end of said hammer abuts said wrench shank, a clock spring in said body, and a key shaft, one end of said clock spring being attached to said key shaft so that a free end thereof is movable relative to said one end, a ratchet plate on said key shaft and having ratchet teeth in its periphery, a pawl movably mounted on said body for travel between a hold position in which said ratchet plate can be moved only in a wind direction, and a release position wherein said ratchet plate is free to turn in either direction, a cross slide member coupled to said hammer for limited movement relative to said body for imparting said pivotal motion to said hammer, means coupling said free end of said spring to said cross slide so that said spring spins said ratchet plate and key shaft when said pawl is moved to its release position, said coupling means including a stud connected to said spring free end, and a striker disc supported on said key shaft for supporting said stud in abutting relationship to said cross slide for moving said cross slide in response to said spring and ratchet plate release spinning, said pawl also serving to release said cross slide when moved to said release position.

* * * * *